United States Patent [19]

Nelson

[11] Patent Number: 4,585,570

[45] Date of Patent: Apr. 29, 1986

[54] BLEACHING COMPOSITIONS

[75] Inventor: Charles R. Nelson, Wetheral, Nr Carlisle, England

[73] Assignee: Imperial Chemical Industries PLC, London, England

[21] Appl. No.: 678,972

[22] Filed: Dec. 6, 1984

[30] Foreign Application Priority Data

Dec. 15, 1983 [GB] United Kingdom ..... 8333426

[51] Int. Cl.[4] ..... A62D 5/00; C11D 7/54; D06L 3/00

[52] U.S. Cl. ..... 252/102; 252/187.25; 252/98; 252/547; 252/187.26; 252/544

[58] Field of Search ..... 252/187.26, 98, 102, 252/173, 525, 544–547, 187.25

[56] References Cited

U.S. PATENT DOCUMENTS 4,229,313 10/1980 Joy ..... 252/98
4,282,109 8/1981 Citrone ..... 252/102

FOREIGN PATENT DOCUMENTS 79697 5/1983 European Pat. Off. .
1466567 3/1977 United Kingdom .
2003522 3/1979 United Kingdom .

*Primary Examiner*—Paul Lieberman
*Assistant Examiner*—John F. McNally
*Attorney, Agent, or Firm*—Cushman, Darby & Cushman

[57] ABSTRACT

Thickened bleach compositions contain hypochlorite mixed with an organic thickening component which comprises one or more amine oxides with one or more deliberately added amines. Particularly preferred amine oxides are those having 13 to 15 carbon atoms in the long chain and the preferred amines are those corresponding to the amine oxide used.

11 Claims, No Drawings

BLEACHING COMPOSITIONS

The present invention relates to bleaching and cleaning compositions containing hypochlorite and in particular to thickened bleach compositions, that is compositions having an increased viscosity as compared with straight aqueous solutions of alkali metal hypochlorite.

Thickened bleach compositions have a number of advantages over unthickened bleach compositions in that the more viscous compositions adhere more readily and for a longer time to vertical and inclined surfaces than do the unthickened compositions. The performance of thickened bleach compositions is therefore superior to that of unthickened bleach compositions for vertical and inclined surfaces such as are found in lavatory pans, urinals, drains, waste pipes and the like. In recent years a number of proposals have been made which provide thickened bleach compositions, for example compositions having viscosities at 25° C. of greater than 10 centistokes, by the addition of suitable thickening agents.

British Patent Specification No. 1,329,086 describes thickened aqueous alkali metal hypochlorite compositions which contain in addition to the hypochlorite, an alkali metal salt of a $C_8$ to $C_{18}$ fully saturated fatty acid and a hypochlorite-soluble surface active agent, the latter being exemplified by an amine oxide containing a $C_8$ to $C_{18}$ alkyl group. The amine oxides described in the specification are those commercially available which are derived from naturally occuring $C_8$ to $C_{18}$ fatty acids, for example coconut acids, lauric acid and myristic acid.

British Patent Specification No. 1,466,560 describes thickened aqueous alkali metal hypochlorite compositions in which the thickening is achieved by mixing hypochlorite solutions with combinations of certain sarcosinate or tauride surfactants with one or more other surfactants which may comprise certain soaps, quaternary ammonium compounds, amine oxides, betaines and/or alkanolamides.

British Patent Specification No. 1,584,379 describes thickened bleach compositions comprising an aqueous solution of an alkali metal hypochlorite containing (a) a sucrose surfactant consisting of one or more esters of a long chain fatty acid with sucrose and (b) another hypochlorite-soluble surfactant, for example a quaternary ammonium compound, an amine oxide, a betaine or an alkanolamide.

British Patent Specification No. 2,051,162A describes thickened aqueous alkali metal hypochlorite compositions which contain, in addition to the hypochlorite, an amide oxide and an alkali metal alkyl sulphate.

British Patent Specification No. 2,003,522A describes thickened aqueous alkali metal hypochlorite compositions which contain a $C_8$ to $C_{20}$ branched chain amine oxide or a mixture of such amine oxides or a mixture of such a branched chain amine oxide with a straight chain amine oxide.

Although thickened bleaches containing a single compound as the thickening agent have been described (see for example British Patent Specification No. 2,003,522A hereinbefore mentioned) it has been found to be economically advantageous to employ at least two, generally organic, compounds as thickening agents for the aqueous hypochlorite solution. A typical and well-known example is that described in U.K. Specification No. 1,329,086 in which thickening is achieved by a combination of a soap and an amine oxide in specified proportions.

We have now surprisingly found that it is possible to prepare thickened bleach compositions using a mixture of an amine oxide and an amine as, if desired, the only organic thickening agent.

Accordingly the present invention provides a thickened bleach composition comprising water, an alkali metal hypochlorite and an organic thickening component comprising one or more amine oxides and one or more amines. Amine oxides are usually prepared in the form of a 30% w/w solution of amine oxide in water by reaction of the corresponding amine(s) with aqueous hydrogen peroxide. Incomplete conversion of the amine in this reaction means that it is usual for the amine oxide product to contain a very small residual amount of amine, typically less than 1% w/w in the amine oxide solution. Hence, prior art thickened bleaches containing amine oxides have inevitably contained a very small amount of residual amine. We have now found that the deliberate addition of further amounts of amine to bleach compositions containing amine oxides and a small amount of such residual amine has a noticeable beneficial effect. There is a significant increase in viscosity thereby enabling the desired viscosity for the bleach to be obtained at a lower level of organic thickening agent and hence at lower cost than similar compositions lacking the added amine.

Preferably the thickened bleach composition of this invention contains 0.3 to 4% by weight, more preferably 0.8 to 3% by weight, of amine oxide expressed on a 100% active basis.

Preferably the weight ratio of amine oxide to amine in the bleach composition is in the range 3:1 to 29:1, more preferably 4:1 to 14:1.

Preferably amine oxides for use in the compositions of this invention are those containing at least 13 carbon atoms in the long chain and more preferably are those containing 13 to 15 carbon atoms in the long chain. The added amine is most suitably the amine or amines corresponding to the amine oxide(s) used in the composition but if desired an amine having a different chain length may be used. Preferably, however, the amine has at least 13 carbon atoms in the long chain, more preferably 13 to 15 carbon atoms. Preferably, the mixture of amine oxide(s) and amine(s) is the sole organic thickening component used in the composition of this invention.

Optionally, thickened bleaches according to this invention can contain additional components frequently incorporated in such compositions including caustic alkali, alkali metal salts, perfume and colourants. Hence compositions according to this invention may include caustic alkali, for example sodium hydroxide, and/or an alkali metal salt, for example sodium chloride, each being present preferably in an amount of 0.5 to 10% by weight. A perfume and/or a colourant may also be present in the composition.

The bleach compositions of this invention preferably contain an amount of available chlorine in the range 1 to 15%. The alkali metal hypochlorite may be a lithium, potassium or sodium hypochlorite, preferably the latter.

The compositions of this invention preferably have a viscosity of at least 10 centistokes at 25° C., measured with an Ostwald viscometer, and a cloud point in excess of 35° C.

The following examples, in which all parts and percentages are by weight and all viscosities are measured at 25° C. with an Ostwald viscometer, further illustrate thickened bleach compositions according to this invention.

EXAMPLES 1 TO 14

Several thickened bleach compositions were prepared by mixing sodium hypochlorite in an amount sufficient to give an available chlorine level of 8%, amine oxide, amine, sodium hydroxide and sodium chloride in cold water. A composition (Example A) not according to this invention and containing no amine oxide or amine was also prepared for comparative purposes. Details of the compositions and their viscosities are shown in the Table in which percentages are by weight.

The beneficial effect of the presence of added amine can be seen from a comparison of the viscosities of, for example, examples 1 and 5, 2 and 6, 3 and 7, 9 to 11.

TABLE 1

| EXAMPLE | AVAILABLE CHLORINE | AMINE OXIDE[1] TYPE | AMINE OXIDE[1] (%) | AMINE[2] TYPE | AMINE[2] (%) | SODIUM HYDROXIDE | SODIUM CHLORIDE | VISCOSITY AT 25° C. (Cs) 1 WEEK |
|---|---|---|---|---|---|---|---|---|
| A | 8 | — | — | — | — | 1 | 0 | 1.6 |
| 1 | 8 | C13/C15[3] | 1.45 | C13/C15[3] | 0.05 | 1 | 0 | 2.9 |
| 2 | 8 | C13/C15 | 1.45 | C13/C15 | 0.05 | 3 | 0 | 8.2 |
| 3 | 8 | C13/C15 | 1.45 | C13/C15 | 0.05 | 1 | 3 | 7.3 |
| 4 | 8 | C13/C15 | 1.45 | C13/C15 | 0.05 | 3 | 3 | 13.0 |
| 5 | 8 | C13/C15 | 1.3 | C13/C15 | 0.2 | 1 | 0 | 8.5 |
| 6 | 8 | C13/C15 | 1.3 | C13/C15 | 0.2 | 3 | 0 | 25.0 |
| 7 | 8 | C13/C15 | 1.3 | C13/C15 | 0.2 | 1 | 3 | 19.0 |
| 8 | 8 | C13/C15 | 1.3 | C13/C15 | 0.2 | 3 | 3 | 44.3 |
| 9 | 8 | C14[4] | 0.87 | C14[4] | 0.03 | 1 | 0 | 8.7 |
| 10 | 8 | C14 | 0.84 | C14 | 0.06 | 1 | 0 | 15.9 |
| 11 | 8 | C14 | 0.81 | C14 | 0.09 | 1 | 0 | 88.5 |
| 12 | 8 | C14 | 0.87 | C14 | 0.03 | 1 | 3 | 13.5 |
| 13 | 8 | C14 | 0.84 | C14 | 0.06 | 1 | 3 | 44.2 |
| 14 | 8 | C14 | 0.81 | C14 | 0.09 | 1 | 3 | 95.7 |

[1]Amine oxide - Expressed on a 100% active basis
[2]Amine - Expressed on a 100% active basis
[3]C13/C15 - Mixed C13/C15 alkyl dimethylamine/amine oxide
[4]C14 - Alkyl dimethylamine/amine oxide

I claim:

1. A thickened bleach composition which comprises water, an alkali metal hypochlorite and an organic thickening component comprising one or more amine oxides and one or more amines wherein the weight ratio of amine oxide to amine is in the range of 3:1 to 29:1.

2. A composition as claimed in claim 1 in which the amine oxide component comprises an amine oxide selected from those containing at least 13 carbon atoms in the long chain.

3. A composition as claimed in claim 2 in which the amine oxide component comprises an amine oxide containing 13 to 15 carbon atoms in the long chain.

4. A composition as claimed in claim 1 in which the amine component comprises the amine(s) corresponding to the amine oxide(s) used in the composition.

5. A composition as claimed in claim 4 in which the amine component comprises an amine containing at least 13 carbon atoms in the long chain.

6. A composition as claimed in claim 5 in which the amine component comprises an amine containing 13 to 15 carbon atoms in the long chain.

7. A composition as claimed in claim 1 in which the composition contains 0.3 to 4% by weight of amine oxide expressed on a 100% active basis.

8. A composition as claimed in claim 7 in which the composition contains 0.8 to 3% by weight of amine oxide expressed on a 100% active basis.

9. A composition as claimed in claim 1 in which the weight ratio of amine oxide to amine is in the range 4:1 to 14:1.

10. A composition as claimed in claim 1 in which the mixture of amine oxide(s) and amine(s) is the sole organic thickening component used in the composition.

11. A composition as claimed in claim 1 in which the composition contains from 0.5 to 10% by weight of a caustic alkali and/or 0.5 to 10% of an alkali metal salt.

* * * * *